United States Patent [19]

Gangwisch et al.

[11] 4,264,464

[45] Apr. 28, 1981

[54] HIGH BULK DENSITY PARTICULATE HEAVY DUTY LAUNDRY DETERGENT

[75] Inventors: William J. Gangwisch, New Brunswick; Virgil J. Richter, West Orange; Harold E. Wixon, New Brunswick; Joseph B. Wraga, Bogota, all of N.J.

[73] Assignee: Colgate-Palmolive Company, New York, N.Y.

[21] Appl. No.: 839,780

[22] Filed: Oct. 6, 1977

[51] Int. Cl.[3] ..... C11D 3/08; C11D 3/10; C11D 3/12; C11D 11/02

[52] U.S. Cl. ..... 252/91; 252/135; 252/140; 252/174.13; 252/174.14; 252/174.25; 252/179; 427/220

[58] Field of Search ..... 252/89, 91, 92, 131, 252/135, 140, 179, 174.14, 174.25, 174.13; 427/220

[56] References Cited

U.S. PATENT DOCUMENTS

| | | | |
|---|---|---|---|
| 3,639,288 | 2/1972 | Kerkhoven | 252/135 |
| 3,755,180 | 8/1973 | Austin | 252/99 |
| 3,868,336 | 2/1975 | Mazzola | 252/527 |
| 3,886,098 | 5/1975 | Di Salvo | 252/540 |
| 3,944,500 | 3/1976 | Gancy | 252/182 |
| 3,971,726 | 7/1976 | Smith | 252/132 |
| 3,985,669 | 10/1976 | Krummel | 252/116 |
| 4,006,110 | 2/1977 | Kenney | 252/540 |
| 4,032,465 | 6/1977 | Bauer | 252/135 |
| 4,115,308 | 9/1978 | Guerry | 252/135 |

FOREIGN PATENT DOCUMENTS

| | | | |
|---|---|---|---|
| 1036456 | 8/1978 | Canada | 252/140 |
| 2519815 | 11/1975 | Fed. Rep. of Germany | 252/140 |

*Primary Examiner*—Dennis L. Albrecht
*Attorney, Agent, or Firm*—Kenyon & Kenyon

[57] ABSTRACT

A free flowing phosphate-free high bulk density particulate heavy duty laundry detergent is comprised of particles of spray dried base beads containing ion exchanging zeolite, sodium carbonate and sodium bicarbonate into which is absorbed a nonionic detergent. The product is made by spray drying an aqueous mixture of the zeolite, carbonate and bicarbonate, optionally with soluble silicate present too, decomposing some of the bicarbonate to carbonate during the drying operation and mixing nonionic detergent in liquid form with the spray dried base beads produced and absorbing such detergent into such beads.

10 Claims, No Drawings

HIGH BULK DENSITY PARTICULATE HEAVY DUTY LAUNDRY DETERGENT

This invention relates to built synthetic organic detergent compositions useful for the heavy duty laundering of washable clothing and other textile items, and to a method for the manufacture thereof. More particularly, it relates to an improved non-phosphate synthetic organic detergent composition based on nonionic synthetic organic detergent, synthetic zeolite builder, sodium carbonate and sodium bicarbonate, which is free flowing and of high bulk density and deposits less residue on washed materials than do various other heavy duty laundering compositions in which comparable quantities of zeolite builder are present.

BRIEF DESCRIPTION OF THE INVENTION

The invention of this application relates to a method of manufacturing a free flowing, phosphate free, particulate, heavy duty laundry detergent having a bulk density greater than 0.6 gram/milliliters which comprises:

(a) preparing a crutcher mix by adding sufficient water soluble sodium silicate to an aqueous slurry of sodium carbonate, sodium bicarbonate and a detergent building ion exchanging aluminosilicate zeolite to form a gel, said zeolite having an average ultimate particle diameter of about 15 microns or less, (b) shearing the gel to reduce the viscosity thereof, (c) adding additional sodium silicate to the sheared get, such that the crutcher mix contains from about 2 to about 15% by weight of the silicate, (d) spray drying the crutcher mix to form spray dired beads having a water content of about 2 to 12% and the proporations of zeolite, sodium carbonate and sodium bicarbonate in the spray dried beads are in the range of 1:0.3–6:0.2–2.0, on an anhydrous basis, (e) mixing with said beads from 0.2 to 1.6 parts of nonionic detergent in liquid form so that such detergent is absorbed into the beads.

DETAILED DESCRIPTION OF THE INVENTION

Although synthetic organic detergent compositions have long been based on mixtures of synthetic organic detergent, usually anionic detergent, such as a linear alkyl benzene sulfonate, and builder salt, usually pentasodium tripolyphosphate, because of anti-eutrophication laws and governmental regulations the phosphate content of heavy duty detergent compositions has been limited and in some instances it has been considered desirable to produce low phosphate or phosphate-free detergent compositions. Water insoluble builders, such as bentonite and natural zeolites had previously been employed in soap and synthetic organic detergent compositions for their desirable effect in removing hardness ions, such as calcium and magnesium ions, from wash waters. More recently, with the availability of synthetic zeolites of improved hardness ion-counteracting properties, such zeolites have been included in detergent products to remove such ions and to improve detergency of the synthetic organic (usually anionic) detergent present. Such products may be of low phosphate content or free of phosphate and may be chemically inactive and non-nutritive, hence not contributing to algae growth and eutrophication of inland waters. Although the detergent compositions may be advantageous in those respects, it has been noted that materials washed with them can have objectionable quantities of residue deposited on them. This is most objectionable when the light-colored residue is readily apparent on a dark material. Accordingly, efforts have been made to reduce the depositing of such residue while still producing a satisfactory detergent. In U.S. Pat. No. 3,985,669 it is reported that less residue is present in such detergent compositions when the quantity of silicate is maintained low. However, with comparatively large quantities of synthetic zeolite, especially that of a type prone to deposit on such substrates, objectionable deposits can still result. Also, reducing the proportion of silicate present may diminish the anti-corrosive effect of such normally desirable component of synthetic detergent compositions. Accordingly, other ways of preventing such deposits have been the subjects of research projects.

Recently it has been considered desirable by the assignee of the present invention to produce free flowing and comparatively high bulk density particulate heavy duty laundry detergents so that relatively small quantities of these can be employed and will effectively clean in normal heavy duty laundering operations. It has been found that a combination of nonionic detergent, synthetic zeolite, sodium carbonate and sodium bicarbonate can be made into a free flowing, high bulk density, phosphate-free product. For example, in U.S. patent application Ser. No. 747,002, filed Dec. 2, 1976, in which one of the present co-inventors is the named inventor, a mixed salt, such as Wegscheider's salt, is tumbled with nonionic detergent and the product is coated with synthetic zeolite powder. While the products made are useful detergents of desired high bulk density, they may be of somewhat different appearance from that of conventional detergents normally purchased by the householder and therefore they might not be as readily accepted in the marketplace. Also, products spray dried from homogeneous crutcher mixes tend to be more uniform in composition and generally the post-spraying and mixing processes utilized in their manufacture do not require as strict controls to assure the production of a desirably homogeneous and free flowing product, compared to the method of Ser. No. 747,002. Additionally, most detergent manufacturers are equipped with spray drying facilities and continuation of the use of such is often economically desirable. The present methods allow the production of a free flowing, high bulk density, phosphate-free (or low phosphate) heavy duty laundry detergent of attractive appearance, good washing properties, low residue deposition characteristics and attractive appearance to be readily carried out by methods utilizing for the most part equipment already on hand and with which operators are familiar.

In accordance with the present invention a method of manufacturing a free flowing phosphate-free particulate heavy duty laundry detergent of a bulk density greater than 0.6 g./ml. comprises spray drying an aqueous mixture of ion exchanging zeolite, sodium carbonate, sodium bicarbonate and water to a moisture content in the range of about 2 to 12%, so that the proportions of zeolite, sodium carbonate and sodium bicarbonate in the spray dried beads produced are in the range of 1:0.3–1.6:0.2–2.0 and mixing with said beads from 0.2 to 1.6 parts of nonionic detergent per part of zeolite, in liquid form, so that such detergent is absorbed into the beads. The invention is also of the product resulting and other such products which comprise beads of zeolite, sodium carbonate and sodium bicarbonate in the proportions of 1:0.3–1.6–:0.2–2.0, having absorbed into them about 0.2 to 1.6 parts of nonionic detergent per part of zeolite. Proportions given are on anhydrous bases.

Nonionic detergents are listed at length in McCutcheon's Detergents and Emulsifiers, 1973 Annual and in Surface Active Agents, Vol. II, by Schwartz, Perry and Berch (Interscience Publishers, 1958), the descriptions of both of which are hereby incorporated by reference. Such detergents may be liquid, pasty or waxy solids at room temperature (20° C.) and are usually either sufficiently water soluble to dissolve promptly in water or will quickly melt at the temperature of the wash water, as when that temperature is about 30° or 40° C. While the nonionic detergent employed will normally be one which is either liquid or pasty at room temperature, often preference will be given to normally liquid products because these readily penetrate into the interiors of the base particles, surprisingly leaving little or no material at the surfaces thereof, thus avoiding any tackiness due to presence of the nonionic detergent at the particle surfaces. The use of the normally liquid nonionic detergents allows room temperature application of the nonionic material to the base particles and avoids problems encountered due to any premature solidification of the nonionic or due to the presence of a pasty material near the surfaces thereof, which can be the result of undesired quick cooling of such nonionic detergent before it has satisfactorily penetrated into the interior of the base particle. Thus, although it would have been expected that one would prefer to employ a solid nonionic detergent or at least one which is normally pasty or semi-solid because it would be considered that such would be less liable to make a tacky product of poor flow properties and susceptibility toward lumping or setting on storage than liquid nonionic detergents, this is not the case. If the base beads are kept warm enough and the nonionic detergent is applied in liquid state, as may be effected when normally solid or pasty nonionic detergent is heated sufficiently, the product resulting, providing that penetration into the base bead interior is sufficient, will be as good as the preferred liquid nonionic detergent-base bead compositions with respect to the flow and non-lumping properties but even in such case the liquid nonionic detergent is more amenable to being dispersed readily in aqueous media and therefore is more quickly effective in wash water. Generally, if a normally pasty, semi-solid or solid nonionic detergent is employed, when it is applied to the base beads it will be in the liquid state and usually will be at a temperature below 50° or 60° C., always below 70° C. and preferably below 45° C. For example, when a normally solid nonionic detergent such as Alfonic 1618–65 is employed, it will be heated so as to be a liquid upon application but when Neodol 25-6.5 or 25-7 is used heating will be unnecessary, providing that room temperature application, such as at 25° C., is effected.

Typical useful nonionic detergents are the poly(lower alkenoxy) derivatives that are usually prepared by the condensation of lower (2 to 4 carbon atoms) alkylene oxide, e.g., ethylene oxide, propylene oxide (with enough ethylene oxide to make a water soluble product), with a compound having a hydrophobic hydrocarbon chain and containing one or more active hydrogen atoms, such as higher alkyl phenols, higher fatty acids, higher fatty mercaptans, higher fatty amines and higher fatty polyols and alcohols, e.g., fatty alcohols having 8 to 20 or 10 or 12 to 18 carbon atoms in an alkyl chain and alkoxylated with an average of about 3 to 30, preferably 5 to 20 and more preferably 5 to 12 lower alkylene oxide, e.g., ethylene oxide, units. Preferred nonionic detergents are those represented by the formula $$RO(C_2H_4O)_nH,$$

wherein R is the residue of a linear saturated primary or secondary alcohol (an alkyl) of 10 to 18 carbon atoms and n is an integer from 5 to 20 or 5 to 12. The preferred nonionic detergents may be referred to as higher fatty alcohol polyoxyethylene ethanols (the terminal ethanolic part of these ethers is included in the number of oxyethylene groups counted in the mol of the nonionic). Typical commercial nonionic surface active agents suitable for use in the invention include Neodol ® 23-6.5, an ethoxylation product with an average of about 6.5 mols of ethylene oxide per mol of a 12 to 13 carbon atom chain fatty alcohol, Neodol 25-7, a 12 to 15 carbon atom chain fatty alcohol ethoxylated with an average of 7 of ethylene oxide units, Neodol 45–11, which is an ethoxylation product (having an average of about 11 ethylene oxide units) of a 14 to 15 carbon atom (average) chain fatty alcohol (all made by Shell Chemical Company) and Alfonic ® 1618-65, which is a 16 to 18 carbon alkanol ethoxylated with an average of 10 to 11 ethylene oxide units (Continental Oil Company). Also useful are the Igepals ® of GAF Co., Inc. In the above description higher, as applied to higher alkyl, higher fatty, etc., means that 8 to 20, preferably from 10 or 12 to 18 carbon atoms are present.

The zeolites utilized in the present invention include the crystalline, amorphous and mixed crystalline-amorphous zeolites of natural or synthetic origin or mixtures thereof that can be of satisfactorily quick and sufficiently effective hardness ion counteracting activity. Preferably, such materials are able to react sufficiently rapidly with a hardness cation such as one of calcium, magnesium, iron and the like, to soften the wash water before adverse reactions of such hardness ions with fibers of the laundry, any soils thereon and any constituents of the synthetic organic detergent compositions made according to the present invention, or any combination thereof. The useful range of calcium ion exchange capacities is from about 200 milligram equivalents of calcium carbonate hardness per gram of aluminosilicate to 400 or more of such milligram equivalents (on an anhydrous zeolite basis), per gram. Preferably such range is about 250 to 350 milligram equivalents per gram.

The water insoluble crystalline alunimosilicates used are often characterized by having a network of substantially uniformly sized pores in the range of about 3 to 10 Angstroms, often being about 4 A (nominal), such size being uniquely determined by the unit structure of the particular type of zeolite crystal. Of course, zeolites containing two or more such networks of different pore sizes can also be satisfactorily employed, as can be mixtures of such crystalline materials with each other, and with amorphous materials.

The zeolite should be a univalent cation-exchanging zeolite, i.e., it should be an aluminosilicate of a univalent cation, such as sodium, potassium, lithium (when practicable) or other alkali metal, or ammonium. Preferably the univalent cation of the zeolite molecular sieve is an alkali metal cation, especially sodium or potassium, and most preferably is sodium, but various other cations are also useful.

Crystalline types of zeolites utilizable as molecular sieves in the invention, at least in part, include zeolites of the following crystal structure groups: A, X, Y, L, mordenite, and erionite, of which types A and X are preferred. Mixtures of such molecular sieve zeolites can also be useful, especially when type A zeolite is present. These crystalline types of zeolites are well known in the art and are more particularly described in the text Zeolite Molecular Sieves, by Donald W. Breck, published in 1974 by John Wiley & Sons. Typical commercially available zeolites of the aforementioned structural types are listed in Table 9.6 at pages 747–749 of the Breck text, which table is incorporated herein by reference.

Preferably the zeolite used in the invention is synthetic and it is most preferable that it be of type A or similar structure, particularly described at page 133 of the aforementioned text. Good results have been obtained when a Type 4A molecular sieve zeolite is employed, wherein the univalent cation of the zeolite is sodium and the pore size of the zeolite is about 4 Angstroms. Such zeolite molecular sieves are described in U.S. Pat. No. 2,882,243, which refers to them as Zeolite A.

Molecular sieve zeolites can be prepared in either a dehydrated or calcined form which contains from about 0 or about 1.5% to about 3% of moisture or in a hydrated or water loaded form which contains additional bound water in an amount from about 4 up to about 36% of the zeolite total weight, depending on the type of zeolite used. The water-containing or hydrated form of the molecular sieve zeolite is preferred in the practice of this invention. The manufacture of such hydrated crystals is well known in the art. For example, in the preparation of Zeolite A, referred to above, the hydrated zeolite crystals that are formed in the crystallization medium (such as a hydrous amorphous sodium aluminosilicate gel) are used without the high temperature dehydration (calcining to 3% or less water content) that is normally practiced in preparing such crystals for use as catalysts, e.g., cracking catalysts. The crystalline zeolite, in either completely hydrated or partially hydrated form, can be recovered by filtering off the crystals from the crystallization medium and drying them in air at ambient or other suitable temperature so that their water contents are as desired, usually being in the range of about 5 to 30% moisture, preferably 15 to 22%. However, because at least partial hydration may sometimes be effected during manufacture of the compositions of the present invention, the moisture content of the molecular sieve zeolite being employed may sometimes be as low as 0 percent at the start of the process of manufacturing the present detergent compositions.

Preferably the zeolite to be used will be initially in a finely divided state, with the ultimate particle diameters being below 15 microns, e.g., 0.001 to 15 microns, preferably being from 0.01 to 10 microns and especially preferably of 0.01 to 8 microns in mean particle size, e.g., 4 to 8 microns, if crystalline and 0.01 to 0.1 micron, e.g., 0.01 to 0.05 microns, if amorphous.

Although the crystalline synthetic zeolites are more common and better known, amorphous zeolites may be employed instead and are often superior to the crystalline materials in various important properties, as will be described, as may be mixed crystalline-amorphous materials and mixtures of the various types of zeolites described. The particle sizes and pore sizes of such materials will usually be like those previously described but variations from the described ranges may be made, providing that the materials function satisfactorily as builders in the present compositions and do not objectionably overwhiten dyed materials with which they are treated in aqueous media. Various suitable crystalline molecular sieve zeolites are described in four U.S. patent applications of Bao-Ding Cheng, Ser. Nos. 467,688, filed May 7, 1974; 503,734, filed Sept. 6, 1974; and 640,793 and 640,794, filed Dec. 15, 1975, all of which are hereby incorporated by reference for such descriptions and for descriptions therein of other materials within this invention. Other useful such molecular sieve zeolites are illustrated in German Offenlegungsschriften No. 2,412,837 and 2,412,839 and in Austrian patent applications A 4484/73; A 4642/73; A 4666/73; A 4717/73; A 4750/73; A 4767/73; A 4748/73; A 4788/73; A 4816/73; and A 4888/73, all of which are incorporated herein by reference. U.S. Pat. No. 3,985,669 and U.S. patent application Ser. No. 747,002, previously mentioned, are incorporated by reference, too, for their descriptions of zeolites and other components of the present compositions and other relevant disclosures.

A preferred ion exchange zeolite is the amorphous zeolite of Belgian Pat. No. 835,351 of the formula $$M_2O.Al_2O_3.(SiO_2)_z.wH_2O,$$

wherein M is a monovalent cation, preferably an alkali metal, z is from 1.5 or 2.0 to 3.8 or 4 (2 is sometimes preferable) and w is from 2.5 to 6, especially when M is sodium. This patent is also incorporated herein by reference to avoid the necessity for lengthy recitations of such materials, methods for their manufacture and uses, etc.

The formula given above may be varied to $$(Na_2O)_x.(Al_2O_3)_y.(SiO_2)_z.wH_2O$$

and usually, when x is 1, y will be from 0.8 to 1.2, z will be from 1.5 to 5 and w will be 0 to 9, such limits preferably being 0.9 to 1.1, 2.0 to 3.8 and 2.5 to 6 or 3.0 to 4.5 when x is 1. The chemical or structural formula will preferably be the following or approximately of that formula:

$$(Na_2O)_6(Al_2O_3)_6(SiO_2)_{12}.27H_2O,$$

but the mols of water present may be 15 to 27, e.g., 20 or 24 to 27. Note that in such chemical formula the x:y:x:w ratio is 1:1:2:4.5.

The alkali metal carbonate and alkali metal bicarbonate may be in the form of a mixture thereof wherein both types of compounds are present in the same individual beads or particles or may be separated. Such materials will desirably be of particle sizes within the No. 20 to 100 range, U.S. Sieve Series, but various other sizes of particles, up to about 8 mesh and as fine as 200 mesh, may be used providing that they dissolve and/or disperse readily in the aqueous crutcher mix. Solutions may also be employed, provided that moisture contents of the crutcher mix made are not thereby made too high. Normally the alkali metal (sodium or potassium being preferred) carbonates and bicarbonates, most preferably as the sodium salts, will be essentially anhydrous in preferred embodiments of the invention but partially hydrated builder salts of this type may also be used. The proportion of alkali metal carbonate to alkali metal bicarbonate, by weight, will generally be within the range of 3:8 to 5:1, preferably being within the range of 1:2 to 2:1, more preferably about 4:3 in the final product and of such proportions, plus about 40 to 60%, e.g., about 50%, to 6 for the bicarbonate and minus 25 to 45%, e.g., about 35%, to 2 for the carbonate amounts in the crutcher mix so that the ratio therein would be 3:1 for bicarbonate:carbonate. The mixed salt, if employed, may be made by a method which results in a substantial content, e.g., 10 to 100% of Wegscheider's salt, with any balance being sodium bicarbonate. Such a product and the carbonate and bicarbonate components are readily made into a suitable aqueous slurry with the zeolite and water, which slurry is easily spray dried to particles which readily sorb nonionic detergent. A method for the manufacture of a mixed carbonate-bicarbonate product which may be used is shown in U.S. Pat. No. 3,944,500 of Gancy et al., hereby incorporated by reference. A useful mixed carbonate-bicarbonate of the type described is available from Allied Chemical Corporation under the name Snowlite, e.g., Snowlite, I, Snowlite II.

The water of the crutcher mix and of the final product is preferably deionized water or water which may be present as the solvent in aqueous solution or dispersion of one or more of the components of the crutcher mix. The water employed, if added, will usually have a hardness content of less than 150 p.p.m., preferably less than 50 p.p.m. and more preferably less than 10 p.p.m., calculated as calcium carbonate. Although deionized water is preferable, tap waters low in hardness contents may also be employed. The moisture contents of the products are those which are removable by heating to a temperature of 105° C. for five minutes.

The alkali metal silicate which may be present in the compositions of this invention is preferably sodium silicate of $Na_2O:SiO_2$ ratio in the range of 1:1.6 to 3.2, preferably 1:2 to 1:3 and most preferably about 1:2.4, e.g., 1:2.35. Such silicate may be added to the aqueous crutcher mix as an aqueous solution, usually containing about 40% of sodium silicate solids. Alternatively, an equivalent silicate may be post-added to the product but such can result in somewhat less desirable final product properties, such as increased residue on washed materials in some cases, although such can also result if the spray dried product is overdried and the silicate is dehydrated excessively.

In addition to the mentioned components of the final product, in preferred compositions various adjuvants will also be favored. For example, to improve cleaning a proteolytic enzyme or equivalent enzyme may be post-added (normally such are not included in the crutcher mix because spray drying has an inactivating effect on such enzymes). The enzymes that may be employed are generally effective at pH ranges from about 4 to 12, preferably about 8 to 11. Although the proteolytic enzymes are subject to some degradation by heat they may be employed in washing solutions at temperatures up to about 80° C. and are also effective at low temperatures, down to about 10° C. Among the proteolytic enzymes that are useful may be mentioned pepsin, trypsin, chymotrypsin, bromelain, collagenase, keratinase, carboxylase, amino peptidase, elastase, subtilisin and aspergillopepidases A and B. Preferred enzymes are subtilisin enzymes manufactured and cultivated from special strains of spore-forming bacteria, particularly Bacillus subtilis.

Proteolytic enzymes such as Alcalase, Maxazyme, Protease AP, Protease ATP 40, Protease ATP 120, Protease L-252 and Protease L-423 are among those enzymes derived from strains of spore forming bacilli, such as Bacillus subtilis. Different proteolytic enzymes have different degrees of effectiveness in aiding in the removal of stains from textiles and linen. Particularly preferred as stain removing enzymes are subtilisin enzymes. Metalloproteases which contain divalent ions such as calcium, magnesium or zinc bound to their protein chains are of interest. The manufacture of proteolytic enzyme concentrates is described in German Offenlegenschrift No. 1,800,508 and in Dutch patent application No., 6,815,944.

Instead of or in partial replacement of the proteolytic enzyme, other enzymes may also be used, usually for specific purposes. Thus, an amylase may be employed, e.g., bacterial amylase of the alpha type, such as is obtained by fermentation of Bacillus subtilis. Among the other enzymes that may be used are those characterized as hydrolytic, lipolytic, oxidizing, reducing and glycolytic. Such include catalase, lipase, maltase and phosphatase. The mentioned enzymes and classes thereof, while considered to be most useful, are not the only effective ones in the present products. Virtually any enzymes that contribute to loosening of the bond by which soils or stains are held to fibrous materials may be used in present formulas. Guides to such use may be found in Principles of Biochemistry by White, Handler, Smith and Stetten (1954).

Another preferred component of the present laundry detergents is a fluorescent brightener. The fluorescent brighteners are members of a well-known class in the detergent art and usually are reaction products of cyanuric chloride and the disodium salt of diamino stilbene disulfonic acid, benzidine sulfone disulfonic acid, amino coumarins, diphenyl pyrazoline derivatives or naphthotriazolyl stilbenes. Such materials are described in the article Optical Brighteners and Their Evaluation by Per S. Stensby, a reprint of articles published in Soap and Chemical Specialties in April, May, July, August and September, 1967, specially at pages 3–5 thereof. Among such brighteners are Tinopal 5BM (Geigy), Tinopal RBS, SOF (Ciba) and one known as Stilbene No. 4 disodium 4,4'-bis-(4-anilino-6-morpholine-s-triazine-2-ylamino)-2,2'-stilbene disulfonate. Of these, Tinopal 5BM is generally preferred.

Various other constituents and adjuvants may be present in the crutcher mix or may be post-added, including foam improvers, foam depressants, fungicides, antioxidants, sanitizers, stabilizers, chelating agents, soil suspending agents, soil anti-redeposition agents, colorants (pigments and dyes), bleaches and perfumes. Such materials are well-known in the art and need not be recited at length here.

The proportions of active materials in the final product should be in the range of 1:0.3–1.6:0.2–2.0:0.2–1.6 for zeolite:carbonate:bicarbonate:nonionic detergent. Normally the proportion of bicarbonate to carbonate will be within the range of 1:2 to 2:1. The percentages of various constituents, including water, are 15 to 40% of zeolite, 10 to 25% of carbonate, 8 to 22% of bicarbonate, 15 to 25% of nonionic detergent and 2 to 10% of moisture. Preferably such ranges will be 20 to 30%, 15 to 25%, 10 to 20%, 18 to 22% and 4 to 8%, respectively. The silicate content may be 3 to 20%, preferably 5 to 15%. Fluorescent brightener content is normally in the range of 0.05 to 3%, preferably 1 to 2.5% and proteolytic enzyme content (including the normal carrier for such enzyme) will be from 0.5 to 3%, preferably 1 to 2%, when present. Various other adjuvants may also be present but the total thereof will not normally exceed 5% and preferably will be less than 3%, with percentages of individual components being less than 1% and preferably 0.5% or less. Thus, from 0.1 to 0.4% of pigment may be present, as may be 0.1 to 0.4% of perfume. If desirable, the percentage of anti-redeposition agent may be as high as 3% but normally the percentage thereof, if it is present, will be from 0.5 to 2%.

The high bulk density particulate heavy duty laundry detergent product of this invention will usually be in free flowing rounded bead form such as that of other spray dried products, although the bead interior may be virtually honeycombed. The particle sizes of the beads will normally be in the range of No's. 6 to 160 sieve, preferably No's. 8 to 100 sieve, with less than 10%, preferably less than 5% and more preferably less than 1% of the product being outside such ranges. The bulk density of the finished detergent will normally be at least 0.6 g./ml., preferably at least 0.65 g./ml and most preferably is in the 0.65 to 0.85 g./ml. range, e.g., 0.71 to 0.83 g./ml. The flow rates of such products are excellent and usually will be greater than 70% of the rate of free flowing sand of similar particle size, normally being from 70 to 90% thereof and preferably 75 to 90% thereof. Although the 0.65 to 0.85 g./ml. bulk density range is preferred, by changing formulas and spray drying techniques it can be changed upwardly and downwardly, e.g, to 0.5 and 0.9 g./ml.

In the manufacture of the invented laundry detergent it is important that a sorptive bead be made for absorption of nonionic detergent therein. Such sorption should be sufficient so that the nonionic detergent is passed into the bead interior and therefore does not tend to cause caking of the beads or poor flow properties. While sodium carbonate of certain types has been found to be an excellent sorbent for nonionic detergents, products made with it alone as the builder, at least in the quantities needed to make compositions of the type which are acceptably detersive, tend to have objectionably high pH's. Also, the presence of bicarbonate with the carbonate appears to be desirable in the making of a free flowing and absorptive produce, as well as in solubilizing the product and additionally, it exerts its buffering effect. Some of the desirable properties of the product may be enhanced by the decomposition of a portion of the bicarbonate during the manufacture of the zeolite—carbonate—bicarbonate beads, with the resulting escape of carbon dioxide from the product and/or the neutralization of any excess or localized alkalinities by the carbonic acid released.

In the zeolite—sodium carbonate—sodium bicarbonate spray dried beads made in accordance with the invention the proportions of such constituents are in the range of 1:0.3–1.6:0.2–2.0, as previously described for the finished product, with the proportion of bicarbonate to carbonate also being as previously given. The bulk density of the spray dried globules will normally be from 0.5 to 0.7 g./ml. without nonionic having been absorbed). The moisture content of the beads will usually be from 2 to 12%, preferably 5 to 10%. The ranges of contents of other components will similarly have limits higher than those indicated for the finished product, with the increase being a function of the proportion of the final product weight to the spray dried bead weight. In other words, if, for example, the final product is identical in composition with the spray dried product except for the inclusion therein (on a final product basis) of 20% of nonionic detergent post-sprayed onto the spray dried beads and absorbed therein, the percentage of zeolite content in the spray dried beads, would have to be 31.3% to yield a product containing 25% thereof. it should be noted that the spray dried base beads will preferably include no detersive component, such as synthetic organic detergent (including soap), nor will they contain any surface active agents such as wetting agents and emulsifiers because such components, it has been found, tend to produce lower bulk density and less internally absorbent spray dried beads or globules. The particle sizes of the beads made are essentially the same as those of the beads in the finished product and their flow rates will be at least 70% of that of sand of comparable particle size.

In the manufacturing of the absorbent, yet comparatively high bulk density spray dried detergent beads, the spray drying operation is conducted in a normal manner but when silicate is present and is to be spray dried with the other base particle components a particular procedure must be followed so as to allow the incorporation of the desired formula quantity of silicate, especially if such quantity is to be in the range of 8 to 20% and even more especially if it is to be 10 to 20%. Ordinary mixing or crutching of the base bead components, the zeolite, carbonate and bicarbonate, with or without small quantities of other non-surface active components, such as stabilizers, brighteners and pigments, may be practiced, followed by conventional spray drying, with powdered silicate, such as hydrous silicates, e.g., hydrous sodium silicate, being post-added, usually with other adjuvants, such as enzyme powders, perfumes, anti-redeposition agents, e.g., sodium carboxymethyl cellulose. In such post-addition processes it is normally desirable for the silicate to be mixed with the base beads prior to the spraying onto said beads of the liquefied nonionic detergent, perfume and other liquid components. However, it is generally better for the enzyme powder, anti-redeposition agent and other such components (which may be of smaller particle sizes than the base particles and also may be less absorbent than the base particles and silicate powder) to be applied after spraying onto the base particles of the nonionic detergent, so that any thin film of nonionic detergent on the surfaces of the base particles or in exposed sub-surface parts thereof, may help to hold the powdered components onto such particles, thereby preventing undesirable sifting and segregation of components in the package.

Although one may add silicate to the base particles, usually in a mixer, such as an inclined cylinder or a Patterson-Kelly or twin shell blender, an improved product of the present composition, producing little or no residue on clothing washed with it, even when cold water is employed, may be made by incorporating the silicate in the crutcher and spray drying it from an aqueous crutcher mix with the rest of the base bead components. By following the procedure of this invention it is found that despite the fact that the presence of significant quantities of silicate in the crutcher mix has with other detergent compositions often produced a product of unsatisfactory flow characteristics, which may tend to cake, the present products are free flowing and absorbent and capable of producing free flowing high bulk density detergent compositions.

Whether or not the silicate is present in the crutcher mix such mix will normally include 40 to 75% of solids and 25 to 60% of water. Preferably, the water content will be 25 to 40 or 50%, with the balance of the mix being non-surface active solids. The crutcher will usually be provided with heat exchange means so that the temperature of the mix may be regulated. Normally it is in the range from room temperature to 90° C., preferably 20° to 70° C. and most preferably 45° to 65° C. Crutching times are usually in the range of 5 minutes to one hour, preferably 10 minutes to 30 minutes. When the silicate is present in the crutcher mix the carbonate, bicarbonate and water, plus any other non-surface active components to be included in the spray dried base beads, e.g., fluorescent brightener, pigments, are mixed together, usually over a period of one to ten minutes, preferably three to seven minutes, and then the silicate is added slowly, preferably as an aqueous solution of 20 to 45%, preferably 35 to 41% solids content, e.g., 40%, with the addition being effected over a period of about two to ten minutes, usually about three to seven minutes, until a viscous slurry, usually of a viscosity or thickness equivalent to about 100 to 100,000 or more centipoises, is obtained. Such slurry will usually include about $\frac{1}{4}$ to $\frac{3}{4}$ of the silicate to be added. During the addition of the silicate mixing is continued at a comparatively low rate, e.g., with the maximum mixer surface speed being about 2 to 10 meters/second, but after formation of the gelled mix of high viscosity or the viscous slurry high shear is applied to the crutcher mix, wherein the shearing speed is from 20 to 50 or more meters/-second, with such shearing continuing for a period normally of about 1 to 20 minutes, preferably 2 to 10 minutes. After reduction of the viscosity of the mix to a workable range, e.g., 10 to 50 centipoises, low speed mixing is resumed and is continued for another 2 to 20 minutes, preferably 5 to 10 minutes, with the regular and gradual addition of silicate, preferably in solution, over that period of time. Usually, such secondary addition of silicate, especially when it is a very water soluble sodium silicate of $Na_2O:SiO_2$ ratio of 1:2 to 1:3, e.g., about 1:2.4, is unaccompanied by additional gelation to a thick mix but if it is the shearing and subsequent addition procedures are repeated until the desired thin crutcher mix of correct composition is obtained. Then the zeolite is admixed with the rest of the crutcher mix, usually over a period of about 1 to 20 minutes, preferably 2 to 10 minutes.

After completion of crutching the crutcher mix is atomized, preferably by being forced through a circular nozzle of internal diameter in the range of about 0.5 to 2 mm., at a pressure of about 10 to 50 kg./sq. cm. gauge, into a spray tower, preferably a countercurrent spray tower, in which the drying air is at a temperature of about 150° to 350° C. The tower may be about 8 to 15 meters high and about 2 to 4 meters in diameter and the product exiting therefrom is of particle sizes substantially in the 6 to 160 U.S. Sieve range and is screened so as to be substantially all within such range or a narrower range, e.g., 8 to 100. Instead of high pressure atomization of the particles through an orifice, spinning disc atomization or equivalent methods may be employed.

After production of the base particles, when they contain no silicate a particulate solid silicate such as hydrous sodium silicate, preferably of the type sold by Philadelphia Quartz Company as Britesil, of a 1:2 or 1:2.4 $Na_2O:SiO_2$ ratio, is mixed with the base beads in an inclined drum or other mixing and/or tumbling device, normally over a period of about 1 to 5 minutes, and nonionic detergent, in liquid state and at a temperature in the range of 20° to 70° C., preferably 30° to 60° C., is sprayed onto the tumbling surfaces of the base beads (sometimes mixed with post-added particulate silicate). The atomized globules of nonionic detergent may be of any suitable size but normally are in the 0.5 to 3 mm. diameter range, preferably 1 to 2 mm. diameter. Spray application of the nonionic detergent to the tumbling particles normally takes place over a period of from 1 to 20 minutes, preferably from 2 to 10 minutes. While the base particles may be heated to temperatures from 30° to 60° C. to promote maintenance of normally pasty or solid nonionic detergent in liquid form this is usually not done because heating of the detergent suffices to accomplish this and for the normally liquid detergents no heating is needed. After completion of addition of the nonionic detergent, other materials to be post-added, such as proteolytic enzyme and perfume, may be applied. It is possible to apply the proteolytic enzyme and any other powders first, merely by mixing it or them with the base particles including nonionic detergent, normally over a period of 1 to 10 minutes, preferably from 1 to 5 minutes, and to post-add the perfume over similar periods of time, preferably as a spray, with the sprayed globules being of sizes like those described for the nonionic detergent.

The advantages of the present invention with respect to product and process have been mentioned but now will be discussed in further detail. The free-flowing high bulk density particulate product lends itself to ready and convenient use. The package employed may be a "bottle", rather than a large detergent box, such a box being less convenient. The bottle may be capped and so may be positively sealed from external moisture, which sometimes causes lumping of detergent, and may be protected from spilling. Because of the higher bulk density, in addition to the packaging being of more convenient size and type, the volume of detergent composition to be utilized is smaller and more readily measured. Of course, great savings in storage and display space at point of sale are made. Although in some circumstances a limited proportion of phosphate, e.g., up to 10%, may be intentionally added to the present compositions, it is a feature of this invention that excellent detergency, with little or no deposition of residue onto washed items, is obtained without the use of any phosphate. Phosphates have generally been considered to be better builders than the other known detergent builders and are usually more sorptive of nonionic detergents and other liquids. Still, in the present case, the combination of carbonate and bicarbonate behaves similarly and is especially useful in conjunction with zeolite and nonionic detergent, preferably with silicate also present. The base beads made, without detergent being present in them, are of the desired characteristics for the subsequent manufacture into a finished detergent composition by post-spraying of a liquid nonionic organic detergent onto them. The combination of carbonate and bicarbonate is a buffered mixture which holds the pH of the product, at 0.07% concentration in wash water ($\frac{1}{4}$ cup in a standard 17 gallon washing machine tub of water), in the range of 8.5 to 11, preferably 9 to 10.5. The mentioned pH is ideal for the action of any enzyme contained in the product and thereby helps to improve the washing and stain removing effect of the detergent compositions. Additionally, because during the spray drying operation some bicarbonate is decomposed to carbonate, carbon dioxide is released and localized areas in the product which may be of higher alkalinity are neutralized, helping to produce a more homogeneous bead, which may help to explain production of a relatively compact or high bulk density and absorbent product. Also, because the bicarbonate does not decompose significantly in the crutcher but does change to carbonate during spray drying, which is effected in a short period of time, any other reactions with base bead components that can take place at higher pH are suppressed in the crutcher due to buffering by the bicarbonate and, if they are time reactions, do not take place appreciably during the spray drying despite the fact that the spray dried base beads, if dissolved in water, will usually have a somewhat higher pH than the crutcher mix.

When silicates are present in the described products, having been spray dried with the base beads, as described, to the desired moisture content, the detergent composition resulting leaves little or no residue on washed laundry, unlike the situation which can prevail when various silicates are post-added or are included with zeolite-containing detergents in significant proportions, like those employed in the present invention.

As a result of the present manufacturing process, wherein silicate is added to a crutcher mix of water, carbonate and bicarbonate, possibly also with fluorescent brightener, pigment and other non-surface active constituents of the product (but not with the nonionic detergent, proteolytic enzyme, perfume and other materials, which it is best to post-add), until a gel or highly viscous crutcher mix is formed, after which addition is halted and the gel is destroyed or reduced in viscosity by application of shearing forces and the balance of the silicate is added, the silicate and/or zeolite do not cause noticeable deposits on the washed laundry. Prior to the method described herein being invented the full quantity of silicate would be mixed in the crutcher with other constituents and although the crutcher mix might not thicken objectionably, the detergent composition made would often objectionably deposit residue on washed items, especially if the amounts of silicate and zeolite were comparatively high. The reason for overcoming this disadvantage is not understood at present but one theory is that the destruction of the silicate gel releases more moisture in the crutcher mix to satisfactorily hydrate the zeolite, preventing the production of anhydrous zeolite and of combinations of zeolite and silicate which are more apt to deposit on the laundry during washing.

The various advantages of the product and process are obtainable without extra materials or processing expenses and the use of phosphate is avoided. Also, because detergents employed are nonionic they are less susceptible to interference from water hardness ions and other impurities and therefore the products are better washing agents under a wider variety of conditions, including cold water washing. Even in high hardness waters the compositions tend to disperse better any insoluble carbonates which may be formed. Finally, although carbonate is waste wash water entering the sewer and passing into inland waters is a source of carbon, required by living organisms, it is not nearly as likely to cause eutrophication of inland waters as is phosphate, in most circumstances, and accordingly, is more tolerable therein.

The following examples illustrate but do not limit the present invention. Unless otherwise indicated all parts are by weight and all temperatures are in °C.

EXAMPLE 1

| | Percent |
|---|---|
| *Neodol 23-6.5 (Shell Chemical Company) | 20.0 |
| **Molecular sieve zeolite 4A, crystalline, ultimate particle size of 4 to 8 microns (Union Carbide Corporation) | 25.0 |
| $Na_2CO_3$ | 18.5 |
| $NaHCO_3$ | 14.0 |
| Sodium silicate ($Na_2O:SiO_2$ = 1:2.4) | 10.0 |
| Tinopal 5BM fluorescent brightener | 2.0 |
| Proteolytic enzyme | 1.5 |
| Ultramarine Blue pigment | 0.2 |
| Perfume | 0.3 |
| Water (including water of hydration of the zeolite, etc.) | 8.5 |
| | 100.0 |

*Condensation product of higher fatty alcohol of an average of 12 to 13 carbon atoms with about 6.5 mols of ethylene oxide/mol.
**Anhydrous basis A free flowing, high bulk density particulate detergent composition is prepared of the above formula and is of essentially globular particles, 99% of which are of sizes (usually considered as of diameters) in the range of 8 to 100 mesh, U.S. Sieve Series. The product has a bulk density of 0.72 g./ml. and flows at a rate of about 77% of that of dry sand of similar particle size, the standard for comparison. It is an excellent heavy duty synthetic organic detergent, useful for both hot and cold water washing of both synthetic and natural fiber textiles and it does not leave objectionable residues on such textiles, such as are often observed after washing with other synthetic detergent compositions wherein substantial proportions of zeolite insoluble inorganic builder and silicate are employed together.

The product is made by admixing in a synthetic detergent or soap crutcher at a temperature of 60° C. (the water is initially heated and heat on the crutcher is maintained to reach and hold such temperature) zeolite, sodium carbonate and sodium bicarbonate, plus stable adjuvants, such as pigment and brightener. The parts by weight employed are 25 of anhydrous zeolite, 11 of sodium carbonate, 22 of sodium bicarbonate, 0.2 of the pigment, 2 of the brightener and 55 of deionized water. Alternatively, city water of low hardness, less then 50 p.p.m., as calcium carbonate, is substituted for the deionized water in some cases. After about five to ten minutes of mixing, to the crutcher mix is added a 40% solids aqueous sodium silicate solution. After about 12 parts of such solution have been admixed, which takes about four minutes, the slurry becomes very viscous, with a viscosity, or of a thickness equivalent to a viscosity, of about 1,000 centipoises or more. During this mixing and that of the water, carbonate, bicarbonate, zeolite, pigment and fluorescent brightener prior to the addition of sodium silicate solution the mixer is set at a comparatively low speed, having a maximum mixing surface speed of about five meters/second. After formation of a thickened mix high shear is applied over a period of about six minutes, wherein the shearing speed is about 35 meters/second, to break the gel and thin out the slurry, after which the balance of the silicate mixture is gradually added, again using the lower mixer speed previously employed. After completion of addition of such balance, which takes about 8 minutes, the crutcher mix is spray dried in a conventional countercurrent spray tower, which is about ten meters high and three meters in diameter, by pumping it at a pressure of about 25 kg./sq. cm. gauge through an orifice about 1 mm. in diameter into drying air (at a temperature of about 300° C. inlet and 110° C. outlet) so as to produce a product substantially in the 6 to 160 U.S. Sieve Series range, which product is cooled to about room temperature and screened so as to be substantially all (over 99%) within such range. Alternatively, screening is effected to particle sizes in the narrower 8 to 100 mesh range. In both instances the base detergent composition beads made are of a high bulk density, about 0.6 g./ml. and are free flowing, with such flow being about 80% or more of that of comparably sized dry sand.

Onto the base beads of 6 to 160 mesh size in an inclined drum blender are sprayed 20 parts of the Neodol 23-6.5 in liquid state at a temperature of about 30° C. The particles onto which the Neodol 23-6.5 is sprayed as a mist, with droplet diameters of about 2 mm., are initially at a temperature of about 30° C. (when normally solid nonionic detergent is used the temperature of the detergent is 40° to 50° C. and the bead temperature may be similarly elevated to prevent immediate solidification of the sprayed on nonionic detergent and to promote such detergent entering the internal pores of the base beads). Such spraying is effected within a period of about 8 minutes, after which the perfume is sprayed on and the proteolytic enzyme powder, of a particle size between 60 and 100 mesh, is dusted onto the surfaces of the particles, still in the mixing drum, each of which procedures takes about three minutes. The product is allowed to cool to 30° C. after absorption of the nonionic detergent (if at a higher temperature) so as to avoid unnecessary loss of perfume components by evaporation.

The finished product, screened to 8 to 100 mesh size, is of the desired high bulk density and very good flow characteristics and is "bottled", packed and warehoused, ready for shipment. When tested, it is found to be a satisfactory heavy duty detergent, useful for washing in both hot and cold waters, and surprisingly, leaves little or no residue of zeolite and/or silicate or other materials on the washed fabrics. The product remains free flowing during storage. It does not cake objectionably nor does it develop lazy flow characteristics. The pH of a 0.07% solution thereof in wash water is about 9.5, an ideal pH for proteolytic enzymatic action, which assists the detergent composition in cleaning and removing stains from washed fabrics, whether of synthetic (nylon, polyester and permanent press natural-synthetic blends) or natural fabrics (cottons).

When, instead of employing the spray drying process, the crutcher mix made is at a temperature in the higher end of the range given, e.g., about 85° C., the water content is cut to the minimum for crutching and spray cooling is employed to produce crystalline hydrates of the hydratable components of the crutcher mix, base particles are made which are treated with nonionic detergent in the manner previously described. However, absorption of the nonionic is not as good and the particles, containing more moisture and more unabsorbed nonionic detergent are of poorer flow characteristics than the preferred product previously described. In another variation of the above experiment, when the silicate is omitted from the crutcher and is post-added as hydrous sodium silicate (Britesil), either before or after addition of the nonionic detergent (before is preferred) a product is obtained which, while being a good heavy duty detergent, of high bulk density, in the range of 0.65 to 0.8 g./ml., and sufficiently free flowing to be commercially acceptable, may not be as good as that of the example with respect to leaving little or no residue on washed fabrics. Although the residue deposited may be acceptable in many cases, especially when the laundry is not dark colored so as to make the lighter colored residue easily apparent, still, residue deposition is objectionable in many instances and is very preferably avoided completely.

In a process variation of the main experiment of this example the mixing operations are conducted using two different vertical mixers, one of which is of either the paddle or helix type and operates at comparatively slow speeds and the other of which is of a counter-rotating shearing disc design and operates at high speeds. One or the other of the mixing elements is employed at a time, with the other being removed from the mixer. The products made, utilizing the combination of mixers rather than the same mixer at different speeds, are of essentially the same properties as that described above but because of the increased shearing efficiency of the one mixer the processing proceeds faster, with a saving of two to six minutes per batch.

Although, as indicated in the main portion of this example, it is usual to post-add the nonionic detergent to the beads shortly after manufacture and also to post-add any other components of the product not in the spray dried base beads this can also be done after aging of the base beads for periods from 20 minutes to several days without loss of their absorbing powers. In such cases it is desirable to heat the beads before application of the nonionic detergent but by proper choice of nonionic detergent type, with respect to melting point, this is avoidable.

EXAMPLE 2

Products of the formula given in Example 1 are made by utilizing different initial proportions of sodium carbonate and sodium bicarbonate and modifying drying tower conditions accordingly so as to cause more or less decomposition of sodium bicarbonate, e.g., from 10 to 70%. For example, instead of employing 22 parts of sodium bicarbonate and 11 parts of sodium carbonate, 18 parts of the bicarbonate and 15 parts of carbonate may be utilized while tower conditions (temperatures, hold-up time) are changed to diminish decomposition of the bicarbonate. Of course, one may start with more bicarbonate, such as 25 parts, and less carbonate, e.g., 8 parts, and utilize increased tower hold-up times and higher temperatures to cause more severe decomposition of bicarbonate. In both such cases the finished product will be of essentially the same properties as that of the preferred embodiment of the invention described in Example 1. Similarly, such a product is obtained when instead of utilizing the separate carbonate and bicarbonate components the starting material employed is one wherein the two are mixed, as in the Snowlite products previously mentioned. Portions of the carbonate and bicarbonate contents or all of such contents may be from commercially available products such as the Snowlites, Wegscheiderite, sodium sesquicarbonate, etc. Of course, with salts which include water of hydration, allowance will be made for the presence of such water as a component of the crutcher mix.

EXAMPLE 3

When, in either of Examples 1 or 2 or both thereof the crystalline zeolite 4A is replaced by the corresponding amorphous material, which has an ultimate particle (diameter) size in the 0.01 to 0.05 micron range or when the "hole" in the zeolite is increased or decreased, while still being good for trapping hardness ions, e.g., to 3 to 6 A, the composition obtained is of essentially the same flow and bulk density properties as that of the product of Example 1, is an excellent heavy duty laundry detergent which leaves no residue on washed clothing and sometimes is of even superior properties with respect to flow and absence of residue, compared to the crystalline product. When such as type X zeolites are employed instead of type A such effects are also obtainable. Similarly, when type Y zeolite is utilized and other equivalents thereto, useful products are obtainable although they are not as good as those utilizing the type A and/or X zeolites.

In addition to varying the type of zeolite present the types of silicates and nonionic detergent may be changed, as may be those of the various adjuvants. Thus, in the experiment of Example 1, instead of employing a silicate of $Na_2O:SiO_2$ ratio of 1:2.4 in the crutcher, such ratio may be 1:2.0, 1:2.35 and 1:2.6, with the products still being like those previously described. Instead of utilizing Neodol 23-6.5, Neodol 25-7 and Neodol 45-11 and equal proportion 2- and 3-component mixtures of such materials may be employed. Neodol 25-7 is a condensation product of a higher fatty alcohol of an average of about 12 to 15 carbon atoms with about 7 mols of ethylene oxide per mol of higher fatty alcohol and correspondingly, Neodol 45-11 is a condensation product of a higher fatty alcohol of an average of 14 to 15 carbon atoms and about 11 mols of ethylene oxide per mol. Instead of Tinopal 5BM, others of the previously mentioned fluorescent brighteners may be substituted or the brightener may be omitted entirely. In the latter case the product obtained is of essentially the same detersive and physical properties, although brightening of laundry is noticeably diminished in the absence of the fluorescent compound. In other variations of the procedure and products of Example 1 the proteolytic enzyme and the Ultramarine Blue are omitted from the formula. Alternatively, the colorant is employed in larger proportion to color some product while other product is uncolored and beads of both types are mixed to produce a speckled version.

In addition to the various components listed others are also included, e.g., inert filler, such as sodium sulfate, anti-redeposition agents, such as sodium carboxymethyl cellulose, antibacterial agents, such as tetrabromosalicylanilide, laundry sweetening (and building salts) such as borax and bleaching materials such as sodium perborate. The stable materials are usually preferably added in the crutcher whereas the others are post-added, either before or after spray-on of the nonionic detergent. When such materials are present in the described compositions, for example, 5% of borax, 5% of sodium sulfate, 0.5% of sodium carboxymethyl cellulose, 0.1% of antibacterial compound and 10% of sodium perborate, the product formula will be modified accordingly, preferably by proportional diminutions of zeolite, carbonate, bicarbonate and silicate contents.

In place of the sodium salts of the various mentioned components corresponding potassium or other suitable soluble salts, preferably alkali metal salts, may be substituted, either in whole or in part, providing that the characteristics of the products obtained are acceptable and within the ranges given.

EXAMPLE 4

A crutcher formula for a product of comparatively high zeolite content is made by admixing 22.0 parts of sodium aluminum silicate (zeolite type 4A, Union Carbide Corporation), 15.2 parts of sodium bicarbonate (industrial grade), 7.6 parts of soda ash (natural), 14.2 parts of sodium silicate solution (47.5% solids content, $Na_2O:SiO_2$ ratio of 1:2.4), 0.1 part of Ultramarine Blue, 1.3 parts of Tinopal 5BM Conc., 39.6 parts of water, and wet and dry remix in such quantity and proportion (q.s.) as to produce a crutcher mix containing 48.0% of solids. The base composition described is spray dried according to the method of Example 1, with the moisture loss being 47.8% and the loss from bicarbonate breakdown to carbonate being 2.5% so that the yield is 49.7%. The product resulting, of particle sizes like those described for the products of Example 1, is post-blended with Neodol 23-6.5, proteolytic enzyme (Maxazyme P-375) and perfume, in respective proportions of 78.4, 20.0, 1.3, and 0.3 and the result is a product containing 26.9% (anhydrous basis) of zeolite, 10.6% of silicate solids, 13.4% of sodium bicarbonate (23.9% was added), 18.7% of sodium carbonate (12% was added), 20% of nonionic detergent, 1.3% of enzyme, 2% of fluorescent brightener, 0.2% of pigment, 6.6% of water and 0.3% of perfume. The cup weight is 155 g. (the cup holds 240 ml.), indicating a bulk density of 0.65 g./ml. Flowability is like that of the product of Example 1 and the product is similarly useful as a heavy duty laundry detergent, with properties like those described for the product of such example.

EXAMPLE 5

The procedure of Example 4 is followed but the proportion of zeolite is diminished and the proportions of bicarbonate and carbonate are increased, with those of the other components remaining approximately the same. Thus, the crutcher formula includes 11.0 parts of sodium aluminum silicate (zeolite type 4A), 25.0 parts of sodium bicarbonate, 6.9 parts of soda ash, 12.9 parts of sodium silicate solution, 0.1 part of Ultramarine Blue, 1.2 parts of Tinopal 5BM Conc., 42.9 parts of water and wet and dry remix (q.s.). The moisture loss on spray drying is 48.3% and the loss from bicarbonate breakdown is 3.5%, resulting in a yield of 48.2%. The base product made is treated with nonionic detergent, enzyme and perfume, as described in Example 4, with the same proportions of base detergent powder and the mentioned three components being employed. The product resulting, of particle sizes like those for the products of Examples 1 and 4, contains 14.0% of zeolite (anhydrous basis), 10.0% of silicate solids, 25.4% of sodium bicarbonate, 20.8% of sodium carbonate, 20% of nonionic detergent, 1.3% of enzyme, 2% of fluorescent brightener, 0.2% of blue pigment, 6.0% of water and 0.3% of perfume. The cup weight, flow characteristics, physical appearance and characteristics and washing properties are like those of the products of Examples 1 and 4 with the exception that some of the hardness counteracting properties of the zeolite are lost due to the diminished quantity thereof present but at the same time the possibility of undesired deposition of zeolite powder on washed laundry is diminished. Flowability is somewhat less than that of the product of Example 4, although it is acceptable.

EXAMPLE 6

The compositions of the products of the previous examples are varied ±10%, ±20% and ±30%, within the ranges given and similarly, the procedures are varied with respect to times and temperatures. The products made are within the ranges for flow characteristics, bulk density, particle size and are of satisfactory heavy duty laundry detersive properties. For example, the moisture content of the finished product is varied to 5%, 6% and 10%, with the dryer products being of better flow characteristics. The nonionic detergent content is increased to as much as 25% with various formulas within the invention and the silicate content is increased to 20% and, with proper selection of the formula to produce the most free flowing product, to as high as 25%. Of course, in all such instances wherein the formulas are varied, both with respect to components and with respect to proportions, care will be taken by one of skill in the art so as to make a product of desired properties by means of a commercially practicable method.

The invention has been described with respect to illustrative examples and descriptions thereof but is not to be limited to these because it is evident that one of skill in the art, with the present specification before him, will be able to utilize substitutes and equivalents and make various modifications within the scope of the invention.

What is claimed is:

1. A method of manufacturing a free flowing, phosphate free, particulate, heavy duty laundry detergent having a bulk density greater than 0.6 gram/milliliters which comprises:

(a) preparing a crutcher mix by adding sufficient water soluble sodium silicate to an aqueous slurry of sodium carbonate, sodium bicarbonate and a detergent building ion exchanging aluminosilicate zeolite to form a gel, said zeolite having an average ultimate particle diameter of about 15 microns or less, (b) shearing the gel to reduce the viscosity thereof, (c) adding additional sodium silicate to sheared gel, such that the crutcher mix contains from about 2 to about 15% by weight of the silicate, (d) spray drying the crutcher mix to form spray dried beads having a water content of about 2 to about 12% and the proportions of zeolite, sodium carbonate and sodium bicarbonate in the spray dried beads are in the range of 1:0.3–6:0.2-2.0, on an anhydrous basis, (e) mixing with said beads from 0.2 to 1.6 parts of nonionic detergent in liquid form so that such detergent is absorbed into the beads.

2. A method according to claim 1 wherein the ion exchanging zeolite is a synthetic sodium aluminosilicate, the crutcher mix that is spray dried includes 10 to 35% of synthetic zeolite, 5 to 20% of sodium carbonate, 10 to 30% of sodium bicarbonate and 25 to 60% of water, with the proportion of bicarbonate to carbonate being within the range of 1:1 to 4:1 in the aqueous mixture and within the range of 1:2 to 2:1 in the spray dried product.

3. A method according to claim 2 wherein the nonionic detergent is a higher fatty alcohol-polyethylene oxide condensate in which the higher fatty alcohol is of 10 to 18 carbon atoms and the polyethylene oxide is of 3 to 30 mols of ethylene oxide per mol of higher fatty alcohol.

4. A method according to claim 3 wherein the bulk density of the product is in the range of 0.65 to 0.85 g./ml. and contains from about 3 to 20% of the water soluble sodium silicate having a $Na_2O:SiO_2$ ratio in the range of 1:2 to 1:3 the zeolite is an amorphous zeolite or crystalline type A zeolite, and the nonionic detergent is a condensation product of a higher fatty alcohol of 12 to 15 carbon atoms and 5 to 12 mols of ethylene oxide per mol.

5. The method of claim 1 wherein the sodium silicate is added to the aqueous slurry of sodium carbonate, sodium bicarbonate and ion exchanging zeolite as a aqueous solution of 20 to 45% solids content, said addition being effected over a period of about two to ten minutes until a gel having a viscosity equivalent of about 100 to 100,000 centipoises is obtained.

6. The method of claim 5 wherein the shearing speed in step (b) is from 20 to 50 meters/second.

7. The method of claim 6 wherein said shearing continues for a period of from about 1 to 20 minutes.

8. A method according to claim 4 wherein the zeolite is crystalline and is of the formula $$(Na_2O)_6 \cdot (Al_2O_3)_6 \cdot (SiO_2)_{12-24} \cdot w\ H_2O\ ,$$

wherein w is from about 15 to 27, mixing is effected in a crutcher at a temperature in the range of about 20° to 70° C., spray drying is effected in a spray tower by drying air at a temperature in the range of about 150° to 350° C., the crutcher mix is atomized by being forced through a circular nozzle of internal diameter in the range of about 0.5 to 2 mm. at a pressure of about 10 to 50 kg./sq. cm. gauge, the spray dried product is screened to sizes in the range of No. 6 to 160, U.S. Sieve Series, the nonionic detergent is a condensation product of a higher fatty alcohol of 12 to 13 carbon atoms and about 6.5 mols of ethylene oxide per mol and is applied to the spray dried particles as they are tumbled in a tumbling drum by spraying it in a liquid state at a temperature in the range of 20° to 70° C. onto the moving surfaces of the spray dried particles to produce particles of sizes in the No. 6-160 U.S. Sieve Series range.

9. A method according to claim 8 wherein the zeolite includes about 20 to 27 mols of water per mol, the silicate is of $Na_2O:SiO_2$ ratio of about 1:2.4, the proportions of materials in the crutcher mix are about 25 parts of zeolite, 11 parts of sodium carbonate, 22 parts of sodium bicarbonate, 10 parts of sodium silicate, 2 parts of fluorescent brightener, 0.2 part of pigment and 70 parts of water, the composition is dried to a moisture content of about 10%, about 20 parts of nonionic detergent are sprayed onto the surfaces of the spray dried beads and about 1.5 parts of proteolytic enzyme powder and 0.3 parts of perfume are post-added thereto to make a product of approximate formula: 20% nonionic detergent, 25% zeolite, 19% sodium carbonate, 14% sodium bicarbonate, 10% sodium silicate, 2% fluorescent brightener, 1.5% proteolytic enzyme, 0.2% pigment, 0.3% perfume and 8% water.

10. The method according to claim 1 wherein said zeolite is a crystalline type 4A zeolite.

* * * * *

UNITED STATES PATENT AND TRADEMARK OFFICE

CERTIFICATE OF CORRECTION

PATENT NO. : 4,264,464

DATED : April 28, 1981

INVENTOR(S) : William Gangwisch

It is certified that error appears in the above-identified patent and that said Letters Patent are hereby corrected as shown below:

Column 4, line 56 change "A" to --Å--

Column 6, line 16-18 after "2,412,839" delete from "and in" to "A 4888/73"

Column 6, line 18 change "all" to --both--

Column 17, line 4 change "A" to --Å--

Signed and Sealed this

First Day of September 1981

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,264,464

DATED : April 28, 1981

INVENTOR(S) : William J. Gangwisch, et al.

It is certified that error appears in the above—identified patent and that said Letters Patent is hereby corrected as shown below:

Column 1, line 31, change "get" to --gel--.

Column 1, line 33, change "dired" to --dried--.

Column 1, line 35, change "proporations" to --proportions--.

Column 1, line 37, delete "6" and insert --1.6--.

Column 3, line 2, after "1.6" delete -- - --.

Column 9, line 62, delete ")".

Column 19, line 50, delete "6" and insert --1.6--.

Signed and Sealed this

Fourth Day of May 1982

[SEAL]

*Attest:*

GERALD J. MOSSINGHOFF

*Attesting Officer*

*Commissioner of Patents and Trademarks*